US005125617A

United States Patent [19]

Miller

[11] Patent Number: 5,125,617

[45] Date of Patent: Jun. 30, 1992

[54] ADJUSTABLE RADIUS WALERS FOR FORMING

[76] Inventor: Alan P. Miller, 104 Amy Ct., New Albany, Ind. 47150

[21] Appl. No.: 766,529

[22] Filed: Sep. 3, 1991

Related U.S. Application Data

[63] Continuation of Ser. No. 501,143, Mar. 29, 1990, abandoned.

[51] Int. Cl.[5] ..... E04G 17/02

[52] U.S. Cl. ..... 249/18; 249/11; 249/17; 249/153; 249/159; 249/164; 249/179; 249/185; 249/192; 249/194; 249/210; 249/219.2

[58] Field of Search ..... 249/10, 11, 17, 18, 249/153, 159, 164, 179, 185, 189, 192, 194, 210, 219.1, 219.2

[56] References Cited

U.S. PATENT DOCUMENTS

| | | | |
|---|---|---|---|
| 851,395 | 4/1907 | Blaw | 249/11 |
| 869,036 | 10/1907 | Wood | 249/179 |
| 959,167 | 5/1910 | Rice | 249/11 |
| 1,327,481 | 1/1920 | Kulow | 249/153 |
| 2,616,148 | 11/1952 | Hawes | 249/144 |
| 3,404,862 | 10/1968 | Chandler | 249/219.2 |
| 3,693,927 | 9/1972 | Jennings | 249/11 |
| 3,871,612 | 3/1975 | Weaver | 249/184 |
| 4,079,910 | 3/1978 | Miller | 249/219.2 |
| 4,185,805 | 1/1980 | Ewing | 249/33 |
| 4,422,617 | 12/1983 | Gallis | 249/219.2 |
| 4,553,729 | 11/1985 | Connors | 249/40 |
| 4,619,433 | 10/1986 | Maier | 249/153 |
| 4,679,763 | 7/1987 | Brotherton | 249/189 |
| 4,729,541 | 3/1988 | Maier | 249/18 |
| 4,742,985 | 5/1988 | Mathis | 249/193 |
| 4,824,068 | 4/1989 | Farland | 249/157 |
| 4,874,150 | 10/1989 | Heinzle | 249/18 |
| 4,890,993 | 1/1990 | Wilson | 249/11 |
| 4,915,345 | 4/1990 | Lehmann | 249/10 |

FOREIGN PATENT DOCUMENTS

| | | |
|---|---|---|
| 0065314 | 11/1982 | European Pat. Off. . |
| 2271368 | 12/1975 | France . |
| 2133826A | 8/1984 | United Kingdom . |

OTHER PUBLICATIONS

PERI Formwork and Scaffolding Handbook (1990) puslibhed Sep. 1989.

*Primary Examiner*—Jay H. Woo
*Assistant Examiner*—Robert B. Davis

[57] ABSTRACT

Forms for a cylindrical wall of poured concrete are made of plywood sheets nailed to horizontally-spaced beams, to which are clamped transversely arranged walers. The walers are assembled in strings and the string are in parallel spaced relationship. The walers in a string are hinged together at the sheet-facing side of the walers and at least one of two adjacent waler sections is curved. Screw assemblies are mounted in brackets located at the ends of the walers but on the sides facing away from the sheets, and are operable to push or pull the walers out of alignment so that they can be pulled or pushed into a ring shape and, in so doing, bend the sheets into generally cylindrical shapes. When the sheets are raised on end, with the beams disposed vertically they provide the inside and outside wall forms for receiving concrete, for example, poured between them to form an annular cylindrical wall for a tank or the like.

5 Claims, 3 Drawing Sheets

Fig.6
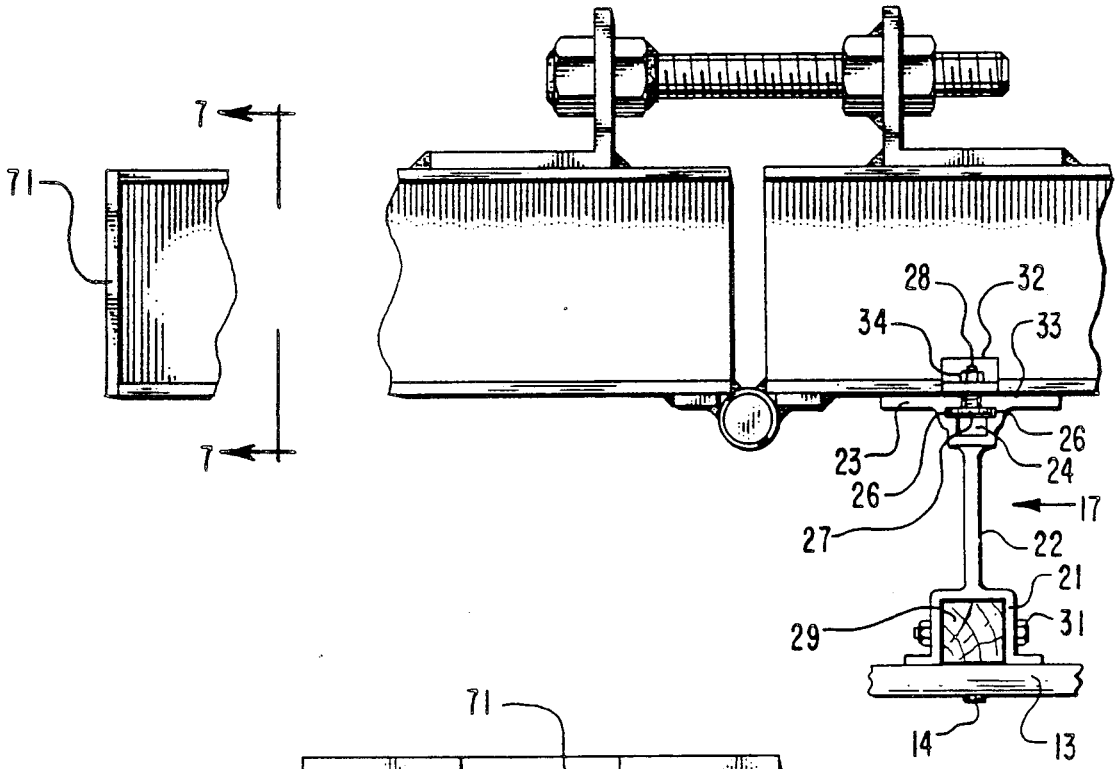
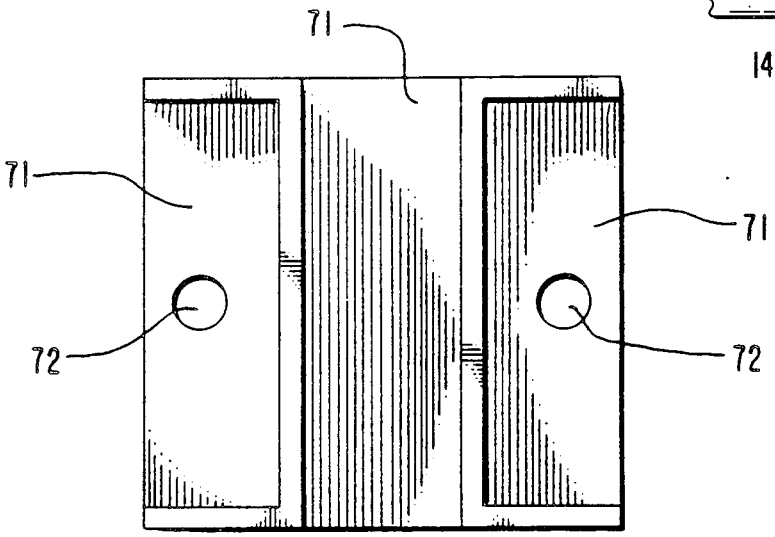
Fig.7

ADJUSTABLE RADIUS WALERS FOR FORMING

This application is a continuation of application Ser. No. 07/501,143, filed Mar. 29, 1990 now abandoned.

BACKGROUND OF THE INVENTION

1. Field of the Invention

This invention relates generally to form work for concrete walls, and more particularly to form construction for curved walls such as for tanks or the like.

2. Description of the Prior Art

There are several patents of which I am aware and which pertain to form work for curved surfaces, and particularly to adjustable forms for that purpose. Examples are U.S. Patents as follows:

| U.S. Pat. No. | Inventor | Date Issued |
|---|---|---|
| 869,036 | Wood | 10/22/07 |
| 3,871,612 | Weaver | 3/18/75 |
| 4,185,805 | Ewing | 1/29/80 |
| 4,553,729 | Connors | 11/19/85 |
| 4,619,433 | Maier | 10/28/86 |
| 4,729,541 | Maier | 3/08/88 |
| 4,742,985 | Mathis | 5/10/88 |
| 4,874,150 | Heinzle | 10/17/89 |

Some of the apparatus disclosed in these patents for constructing forms for curved walls is specially made construction which is either not generally and readily available or is fairly complicated and involves considerable work to assemble it, and susceptible to damage or deterioration in use. Examples are shown in the Wood, Maier '433, Maier '541, Mathis, and Ewing patents. The Weaver patent appears to rely on wires to hold interfitting form or mold boards together.

In the Heinzle patent, the form work boards 12 must be dismounted when the curvature of the stretchers 5 is changed.

The Connors patent uses combinations of "mini-walers" and vertically extending "strongbacks" to provide a substantially curved form wall.

The present invention is directed to providing convenient means for on-site assembly of forms which are comparatively light in weight, durable in nature, and reliable in use.

SUMMARY OF THE INVENTION

Described briefly, according to a typical embodiment of the present invention, a form for a poured concrete wall is made of plywood sheets fastened to horizontally-spaced vertical beams, to which are fastened vertically-spaced rings of walers. The walers in a ring are hinged together so that they can be pulled or pushed into a ring shape and, in so doing, bend the sheets into generally cylindrical shapes to provide the inside and outside wall forms for receiving concrete, for example, poured between them to form an annular cylindrical wall for a tank or the like.

BRIEF DESCRIPTION OF THE DRAWINGS

FIG. 6 is a view like FIG. 3 but showing an alternative construction of one of the members of the waler assembly and which is useful, when desired, at select locations on the formwork.

FIG. 7 is a section therethrough obtained at line 7—7 in FIG. 6 and viewed in the direction of the arrows.

DESCRIPTION OF THE PREFERRED EMBODIMENT

Figure 1:
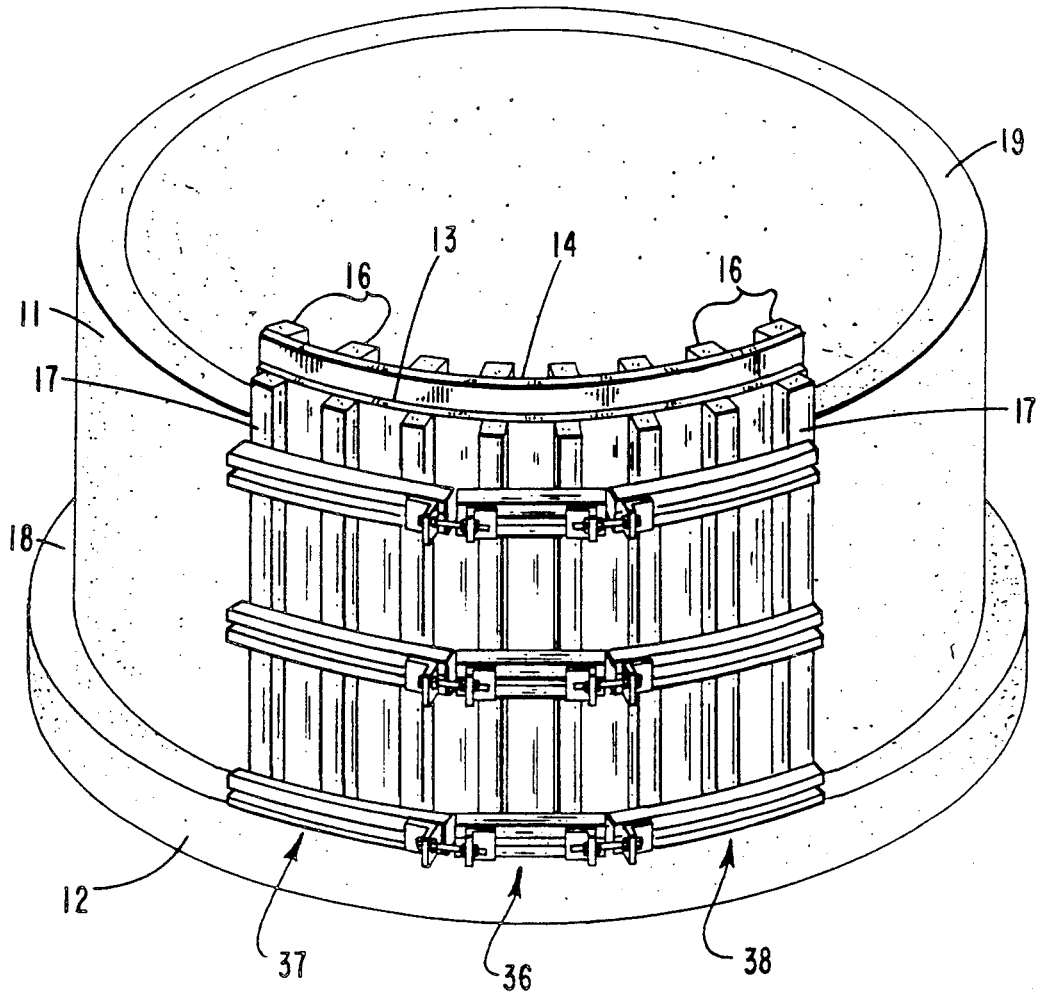
FIG. 1 is a schematic pictorial view showing one use of waler assemblies of the present invention and just before completion of removal of the last of the forms from a poured concrete tank wall.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, there is shown a cylinder 11 with a bottom flange 12. This is actually a schematic representation of a concrete tank wall 11 on a concrete footing 12 for a tank which may be used for a variety of purposes and in very large sizes. In this example, it is shown to be of relatively small diameter to conserve space in the drawing, but the tank could, in fact, be relatively large in diameter, 70 feet being one example. A couple examples are settling tanks in a wastewater treatment plant, or confinement walls at a petroleum tank "farm." The concrete wall is made by placing the concrete by pouring, pumping, or otherwise between an outer generally cylindrical form 13 and an inner cylindrical form 14. The forms are typically assemblies of large sheets of plywood or other suitable materials and which are assembled in the desired shape and height. The present invention is directed toward a way of making this easy.

For that purpose, the invention uses a horizontally spaced series of vertical members 16 on the inside form wall and 17 on the outside form wall. A product which is available for that purpose and which is employed with the walers of the present invention, is called the Aluma Beam marketed by Aluma Systems Incorporated, 4800 Dufferin Street, Downsview (Toronto), Ontario, Canada M3H 5S9. These beams are available in lengths in excess of 8 feet. As shown in the drawing, their orientation is vertical, so they can be cut to whatever length is desired, or purchased in the desired length, to equal or exceed the full height of the wall from the top of the footing 18 to the top of the wall 19, if desired. Shorter lengths can be used and spliced together end-to-end, if desired. Since these beams are purchased-finished for the practice of the present invention, they are only shown symbolically in FIGS. 1 and 2, but one example is shown in some detail in FIG. 6. They typically include a U-shaped channel 21, web 22 and a base 23. The base also has a modified U-shaped channel or slot 24 with longitudinally extending side grooves 26 which receive the head plate 27 of a threaded stud 28. The channel 21 receives a wood rail 29 in it and which is pushed into the channel and further secured in the channel by a series of bolts or screws 31 spaced along the length of it. The form face board 13 is fastened to these nailing strips by nails such as 14. This construction of the Aluma Beam and the manner of nailing form board 13 to it, and the provision of clamping studs with base plates slideable longitudinally in the slot 24 of the Aluma Beam, are well-known in the art. The studs 28 serve as mounts for clamps 32 which can be bolted to the face 33 of the Aluma Beam base 33 by nuts 34. In this manner the base of the Aluma Beam can be clamped to flanges of other beams, stays or walers arranged transversely to the Aluma Beams as in the practice of the present invention.

Figure 2:
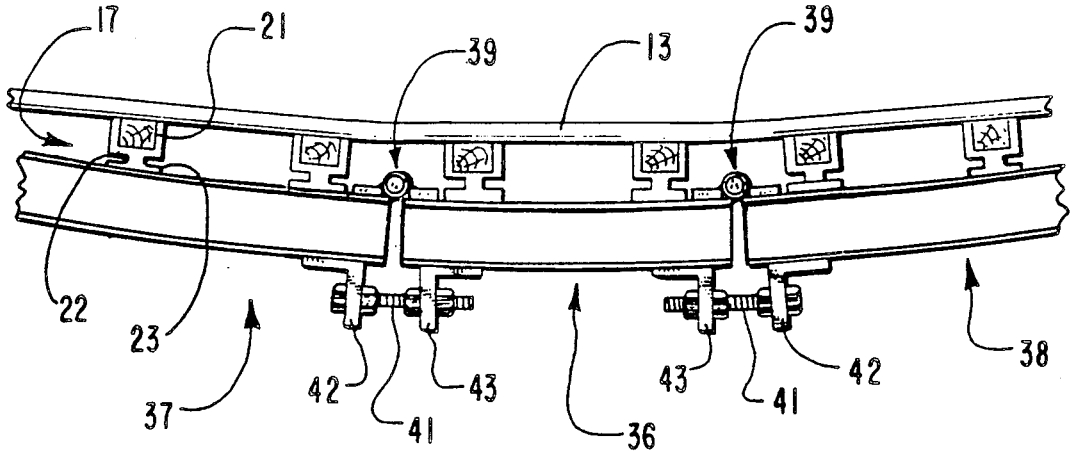
FIG. 2 is an enlarged fragmentary top plan view of a portion of the outside formwork of FIG. 1.
Figure 5:
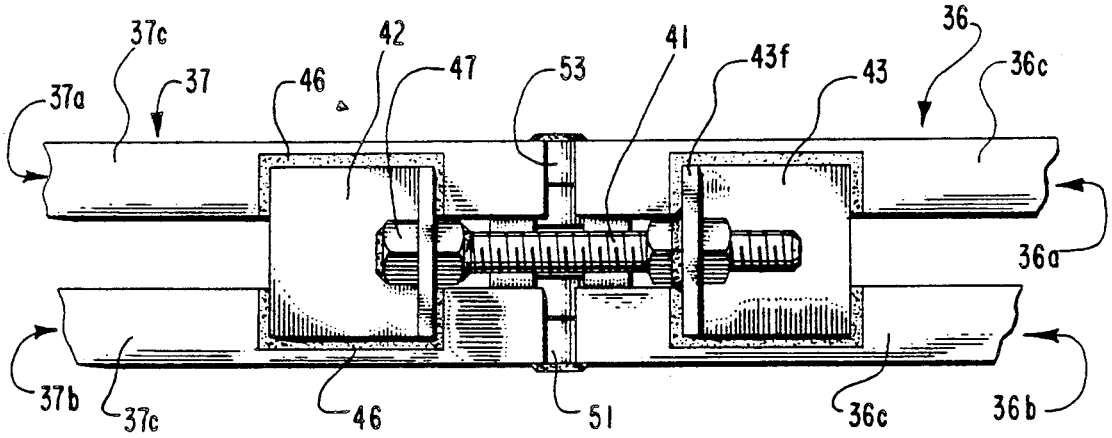
FIG. 5 is an outside face view of the assembly portion shown in FIG. 3.

Referring more specifically to the present invention, FIG. 1 shows fragmentarily three adjustable radius waler assemblies vertically spaced on the outside form assembly. FIG. 2 shows one of these enlarged and will be described in some detail. Referring to FIG. 2 one short waler 36 is shown between two longer walers 37 and 38. The length of the walers can be selected depending upon the effect desired, the shape to be achieved and the amount of curvature achievable in the form face board 13. For example, the waler 36 may be 1 foot 11¼ inches long, while walers 37 and 38 may be 2 feet 7⅝ inches long. The ends of walers 37 and 38 can be connected to other walers in the same manner shown FIG. 2 or in another manner as will be described hereinafter. The walers shown in FIG. 2 are connected by hinge assemblies at 39 and which are identical. Adjustments of the end gap between adjacent walers are achieved by bolts 41 mounted in angle brackets 42, 43.

Figure 3:
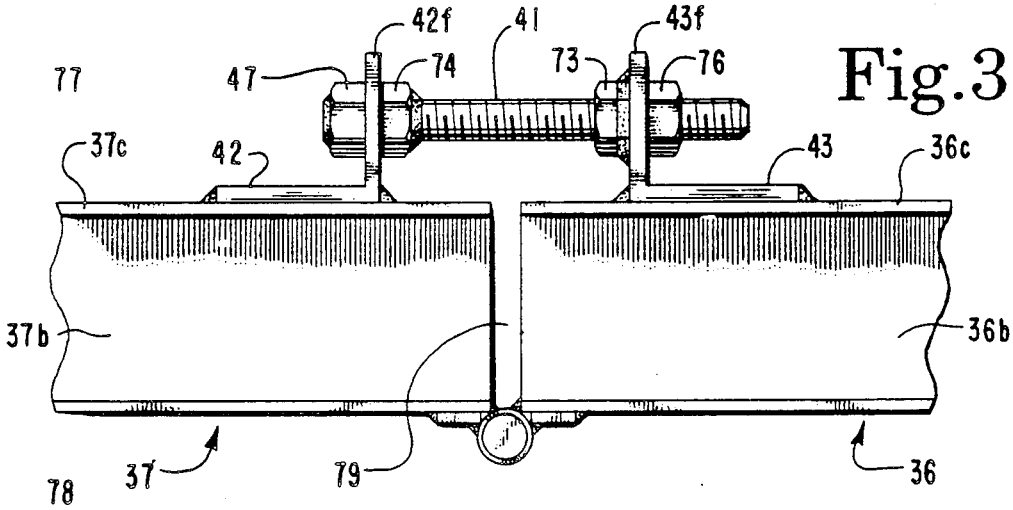
FIG. 3 is a further enlarged fragment of the waler assembly but turned upside down as for the inside formwork and showing details at one of the hinged joints.

Referring now to FIG. 3 for more specific detail, it should first be noted that FIGS. 3–6 show the walers oriented as those secured to the inside form boards 14. But the construction is the same as the outside walers, so the same reference numerals as used in FIGS. 1 and 2 will be used in the remaining figures to designate the same components.

Figure 4:
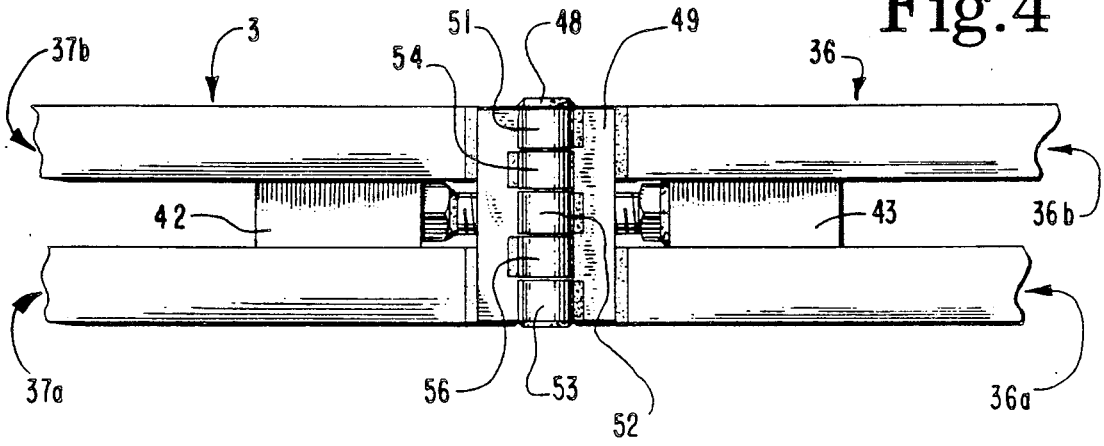
FIG. 4 is an inside face view of the assembly portion shown in FIG. 3.

The waler 37, for example, includes two elongated channel members 37*a* and 37*b* of five inch, 6.7 pound per foot hot rolled steel channel rolled hard way to web on a 32 to 33 foot inside radius. At each end there is an angle such as 42 or 43 secured to the channel members by welding as at 46. The base plates of these angles at each end of the channel such as 37*a* and 37*b* and 36*a* and 36*b* fix the channels in spaced relationship to each other at one plane of the flanges and designated 36*c* and 37*c* in the drawings. At the other plane of the flanges, there are hinge plates mounted as best shown in FIG. 4. In this particular example because the hinge pins 48 are large, the hinge eyes are short lengths of pipe welded to hinge plates. More specifically, hinge plate 49 has the eyes 51, 52, 53 welded to it. Hinge plate 42 has the eyes 54 and 56 welded to it. The head of hinge pin 48 is welded to the eye 51.

This arrangement of angle brackets and hinge plates at opposite ends of the walers is used to hold the waler channel components together in rigid relationship except at a non-hinged end such as shown in FIG. 6 where a plate 71 is welded across the ends of the waler channels. This plate has holes 72 in it for bolting to the same kind of end on another waler (not shown) in an assembly.

Referring again to FIGS. 3 and 4, there is a nut 73 welded to the upstanding flange 43*f* of angle 43. A nut 74 is welded to the bolt 41. A nut 76 is threaded onto the end of the bolt opposite the head 47. With this construction, and when the nut 76 is backed off from the flange 43*f*, the bolt is free to be rotated (as by a wrench) in the upstanding flange 42*f* of the angle bracket 42. Depending upon the direction of rotation, the bolt will be threaded into or out of the nut 73 welded to the flange of bracket 43. If the bolt is turned clockwise as viewed from the left, and assuming a right-hand thread on the bolt 41, the waler 37 will move relative to the waler 36 in the direction of the arrow 77. This is the direction of movement which would be employed for the inside wall form. For the outside wall form, the bolt at 47 would be turned in the counter clockwise direction as viewed from the left. In that case, the relative movement of the waler 37 relative to waler 36 would be in the direction of the arrow 78. The gap 79 between the waler ends, and which is nominally 0.75 inches, is opened.

In the use of the apparatus, the form boards are selected in whatever size and material is convenient and suitable for the application. An example is 4′×8′ sheet of ¾″ plywood. The Aluma Beams can be placed on the ground or other flat surface, with the nailing strips 29 up. The beams are placed on the ground parallel to each other and at one foot spacings. Then the plywood sheet is nailed to the Aluma Beams by nails such as 14. Then the sheet is turned over and placed on the ground. At that time the walers, all of them in alignment as shown in FIGS. 3 and 6, for example, are placed on top of the top faces 33 of the flanges 23 of the Aluma Beams and crosswise to them, typically perpendicular to them as shown in FIGS. 1,2 and 6. The walers are secured to the Aluma Beams by clamps 32 tightened by the nuts 34 on the studs 28.

After all the walers needed for the particular sheet or sheets for one group have been installed, the form assembly can then be raised in place such as on the footings shown in FIG. 1. Then the bolt heads 47 can be turned to begin producing a bow in the form board, either in a concave sense for the outer form board 13, or a convex sense for the inner form board 14, until the desired nominal radius of curvature is achieved. Additional assemblies of the same nature can be installed, and the abutting ends thereof can be bolted together by bolts passing through the holes 72 in end plate 71 of the abutting waler ends. Alternatively, they can be hinged together. The overall horizontal length of a three piece waler assembly of the type shown in FIG. 1 is slightly less than eight feet so that conventional sheets of plywood eight feet long can be conveniently used. The four foot ends of the sheets have filler angles (not shown) mounted to them as is known in the art and by which the vertical ends of the sheets in the assembly of FIG. 1 can be attached to the ends of the sheets of the next adjacent assemblies (not shown in FIG. 1), as the forms are set in a circle.

It is preferable to arrange the walers so that, when erected, the first assembly will be about twenty inches from the bottom of the form sheet. A vertical spacing of five to six feet from the first waler assembly to the one next above it, and between successive waler assemblies is desirable.

The arc in the walers is very desirable, as it makes possible the production of forms useful for tank walls ranging from thirty-two feet in diameter to greater than one hundred forty feet. To pull or push the plywood into smaller diameters within this range, it may be necessary to use two sheets of ⅜ inch or three sheets of ¼ inch thick plywood.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a form assembly wherein wall forms include an outer upstanding wall-forming sheet and an inner upstanding wall-forming sheet in horizontally spaced relation to provide a space between the sheets to receive a poured settable material, the sheets having complementary surfaces facing each other across the space, the improvement comprising:

a plurality of horizontally-spaced vertically-extending beams affixed to the sheets;

a plurality of horizontally-extending, vertically-spaced adjustable radius waler assemblies affixed to the beams, said waler assemblies having adjustment means thereon located far enough from the sheets to operate, when activated to bend the sheets to form surfaces of revolution about vertical axes, whereby a plurality of outer wall-forming sheets in end-to-end relationship and a plurality of inner wall-forming sheets can be configured to form a generally cylindrical space between the outer wall-forming sheets and the inner wall-forming sheets, for providing a form for a poured annular cylinder;

each waler assembly having at least two walers hinged to each other end-to-end at a location spaced from the sheet which is affixed to the beams to which the waler assemblies are affixed;

each waler of said two walers having a hinge plate attached to the waler at an end of the waler, the hinge plates having interfitting hinge eyes with a pin through them to provide a hinge axis where the walers are hinged to each other, the hinge axis being vertical and parallel to the beams and spaced from the sheet;

at least one of the walers comprising a pair of parallel, vertically spaced elongate channels, each channel having a web in a horizontal plane, and each channel having inner and outer vertical flanges at each side of the web, the pair of channels being secured in said vertically-spaced relationship by one of the hinge plates at one vertical flange of each of the channels and by a bracket base secured to another vertical flange of each of the channels, and each of the channels being curved about an axis perpendicular to the plane of the channel web.

2. The improvement of claim 1 and wherein the radius of the curve to the flange nearest the sheet fastened to the beam to which the waler is fastened is about 32 to 33 feet.

3. In a form assembly wherein wall forms include an outer upstanding wall-forming sheet and an inner upstanding wall-forming sheet in horizontally spaced relation to provide a space between the sheets to receive a poured settable material, the sheets having complementary surfaces facing each other across the space, the improvement comprising:

a plurality of horizontally-spaced vertically-extending beams affixed to the sheets;

a plurality of horizontally-extending, vertically-spaced adjustable radius waler assemblies affixed to the beams, said waler assemblies having adjustment means thereon located far enough from the sheets to operate, when activated to bend the sheets to form surfaces of revolution about vertical axes, whereby a plurality of outer wall-forming sheets in end-to-end relationship. and a plurality of inner wall-forming sheets can be configured to form a generally cylindrical space between the outer wall-forming sheets and the inner wall-forming sheets, for providing a form for a poured annular cylinder;

each waler assembly having at least two walers hinged to each other end-to-end at a location spaced form the sheet which is affixed to the beams to which the waler assemblies are affixed, to provide a hinge axis where the walers are hinged to each other, the hinge axis being vertical and parallel to the beams and spaced from the sheet; and at least one of the walers comprising a pair of parallel, vertically spaced elongate rails, each rail being curved about an axis of curvature which is parallel to the hinge axis and remote from the hinge axis.

4. The improvement of claim 3 and wherein the radius of the curve from the axis of curvature to the portion of the rail nearest the sheet affixed to the beam to which the rail is affixed is about 32 feet.

5. The improvement of claim 4 and wherein the adjustment means are more remote than the hinge axis from the sheet affixed to the beam to which the rail is affixed.

* * * * *